US006929325B1

(12) United States Patent
Goelo

(10) Patent No.: US 6,929,325 B1
(45) Date of Patent: Aug. 16, 2005

(54) PORTABLE ERGONOMIC CUSHION

(76) Inventor: Francois Goelo, 1300 South Sound Road P.O Box 10910, Grand Cayman BWI (KY)

( * ) Notice: Subject to any disclaimer, the term of this patent is extended or adjusted under 35 U.S.C. 154(b) by 0 days.

(21) Appl. No.: 10/377,002

(22) Filed: Mar. 3, 2003

(51) Int. Cl.[7] ..... A47C 1/16
(52) U.S. Cl. ..... 297/219.1; 297/229; 297/250.1; 297/284.6; 297/284.7; 297/183.5
(58) Field of Search ..... 297/219.1, 228.12, 297/229, 250.1, 284.5, 284.6, 378.1, 380, 297/382, 183.5, 284.7

(56) References Cited

U.S. PATENT DOCUMENTS 1,404,451 A * 1/1922 Love ..... 297/229
2,307,331 A * 1/1943 Parker, Jr. ..... 297/284.5
2,734,556 A * 2/1956 Hebrank ..... 297/230.1
3,112,956 A * 12/1963 Schick et al. ..... 297/219.1
3,222,694 A * 12/1965 Schick ..... 5/653
3,279,849 A * 10/1966 Radke et al. ..... 297/284.5
4,824,169 A * 4/1989 Jarrell ..... 297/284.1
5,054,854 A * 10/1991 Pruit ..... 297/284.3
5,501,508 A * 3/1996 Llewellyn ..... 297/397
5,702,153 A * 12/1997 Pliska ..... 297/256.16
5,839,783 A * 11/1998 Black ..... 297/380
5,868,463 A * 2/1999 MacKenzie et al. ... 297/228.12

* cited by examiner

*Primary Examiner*—Peter R. Brown
(74) *Attorney, Agent, or Firm*—Stephen Lewellyn

(57) ABSTRACT

A new and improved portable ergonomic cushion for relieving pressure on the coccyx (tailbone) and on the ischial tuberosities, for promoting correct positioning of the sacro-iliac joint and for supporting the lower back of the user is described. The portable ergonomic cushion includes a narrow ridge back support allowing the cushion to be used with numerous styles of chairs and seats, and a lumbar support cushion that is removably attached to the back support. The portable ergonomic cushion may also make use of inflatable cushions for increasing the flexibility of the sitting cushion by allowing users to adjust the cushions to their desired support by varying the amount the cushions are inflated. The portable ergonomic cushion is also foldable into a compact non-use position for easy transportation and storage, and futher does not require the use of straps for retaining the cushion while in use.

10 Claims, 4 Drawing Sheets

PORTABLE ERGONOMIC CUSHION

BACKGROUND OF THE INVENTION

1. Field of the Invention

The present invention relates to a portable ergonomic cushion for relieving pressure concentrations on the tailbone of the user and for supporting the lower back region of the user. The portable ergonomic cushion has particular utility in connection with providing a cushion that relieves pressure on the tail bone and supports the lumbar region of the user, and is compact and portable and readily fits chairs and seats of various construction for supporting the user and relieving strain on the user.

2. Description of the Prior Art

Portable ergonomic cushions are desirable for increasing the comfort level and for reducing strain on the user while supporting the user for extended periods of sitting. When sitting for an extended period of time one tends to develop aches or sores on areas that have pressure exerted thereon with out periods of relief. One problematic area leading to discomfort is the coccyx (tailbone), this area is normally subjected to undesirable pressure resulting from extended periods of sitting and is especially prone to soreness when sitting upon a hard surface. Once a sore or bruise begins to develop it is very difficult for the person to sit for any length of time with out some level of discomfort. This discomfort can and normally leads to creating soreness or discomfort in other regions of the body from the person slouching trying to reduce pressure exerted on the tailbone. The lumbar region of the person's lower back is very prone to becoming sore as a result of slouching. To promote healing or to reduce discomfort pressure must not be exerted on the problematic areas, as such the use of sitting devices to reduce pressure exertion and to prevent the sores from developing are known in the prior art.

For example, U.S. Pat. No. 5,702,153 to Pliska discloses a portable tail bone cushion having a removable back support. However, the Pliska '153 patent does not have an adjustable lumbar cushion, and has further drawbacks of a wide back support which may prevent the use of the back support in connection with the tail bone cushion with seats and chairs having contoured or narrow backs.

U.S. Pat. No. 4,864,668 to Crisp discloses a portable back support that is narrow. However, the Crisp '688 patent does not include a positionable lumbar cushion and additionally does not provide a seat cushion for alleviating pressure exertion on the tail bone.

Similarly, U.S. Pat. No. 2,734,556 to Hebrank discloses a combination seat and fatigue-relieving back rest that includes a lumbar supporting cushion and a seat cushion. However, the Hebrank '556 patent does not have a narrow back support, and can not relieve pressure exerted on the tail bone by preventing the tail bone from coming into contact with a surface.

Another patent of interest is, U.S. Pat. No. 3,205,010 to Schick discloses a seat cushion for relieving pressure exerted on the tail bone. However, the Schick '010 patent does not have a lumbar supporting cushion, and it does not provide a ridge narrow back support.

Lastly, U.S. Pat. No. 5,452,940 to Maier discloses a pressure relief back cushion that relieves pressure on the tail bone and includes a lumbar support cushion. However, the Maier '940 patent does not provide ridge narrow back support with a removable lumbar support cushion, and has the additional deficiency of requiring straps to hold and position the cushion on a seat.

While the above-described devices fulfill their respective, particular objectives and requirements, the aforementioned patents do not describe a portable ergonomic cushion that provides a cushion that relieves pressure on the tail bone and supports the lumbar region of the user, and is compact and portable and readily fits chairs and seats of various construction for supporting the user and relieving strain on the user. The Pliska '153 patent, the Schick '010 patent, the Maier '940 patent, and the Hebrank '556 patent the make no provision for a narrow ridge back support. The Pliska '153 patent and the Crisp '688 patent doe not include a positionable lumbar cushion. Additionally, the Crisp '688 patent does not provide a seat cushion for alleviating pressure exertion on the tail bone.

Therefore, a need exists for a new and improved portable ergonomic cushion that can be used for relieving pressure on the tail bone and for supporting the lumbar region of the user, and is compact, portable and readily fits chairs and seats of various construction for supporting the user and relieving strain on the user. In this regard, the present invention substantially fulfills this need. In this respect, the portable ergonomic cushion according to the present invention substantially departs from the conventional concepts and designs of the prior art, and in doing so provides an apparatus primarily developed for the purpose of providing a cushion that relieves pressure on the tail bone and supports the lumbar region of the user, and provides personalized optimum seating comfort and support wherever one may travel.

SUMMARY OF THE INVENTION

In view of the foregoing disadvantages inherent in the known types of sitting devices to reduce pressure exertion and to prevent sores from developing now present in the prior art, the present invention provides an improved portable ergonomic cushion, and overcomes the above-mentioned disadvantages and drawbacks of the prior art. As such, the general purpose of the present invention, which will be described subsequently in greater detail, is to provide a new and improved portable ergonomic cushion and method which has all the advantages of the prior art mentioned heretofore and many novel features that result in a portable ergonomic cushion which is not anticipated, rendered obvious, suggested, or even implied by the prior art, either alone or in any combination thereof.

To attain this, the present invention essentially comprises a seat cushion with a semi-circular cutout positioned to reduce pressuring applied to the coccyx (tail bone). A back support connected to the seat cushion that is substantially narrower than the seat cushion, substantially narrower meaning at least thirty five percent (35%) narrower than the seat cushion, and a lumbar support cushion removably attached to the back support. In addition, one of the key aspects of the present invention is not requiring the use of straps or other similar means for retaining the seat cushion to a seat or chair in which the cushion is being used with.

There has thus been outlined, rather broadly, the more important features of the invention in order that the detailed description thereof that follows may be better understood and in order that the present contribution to the art may be better appreciated.

The invention may also include the seat cushion being generally rectangular in shape. The seat cushion may include a core and a covering which completely encloses the core. The core may be inflatable or constructed from cellular foam, foam rubber or polystyrene. The cover may be made of cloth, vinyl, velour or leather. The lumbar support cushion may include a strap for attachment to the back support, and the back support may be fluted for increased support. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable ergonomic cushion that has all of the advantages of the prior art sitting devices to reduce pressure exertion and to prevent the sores from developing and none of the disadvantages.

It is another object of the present invention to provide a new and improved portable ergonomic cushion that may be easily and efficiently manufactured and marketed.

An even further object of the present invention is to provide a new and improved portable ergonomic cushion that has a low cost of manufacture with regard to both materials and labor, and which accordingly is then susceptible of low prices of sale to the consuming public, thereby making such portable ergonomic cushion economically available to the buying public.

Still another object of the present invention is to provide a new portable ergonomic cushion that provides in the apparatuses and methods of the prior art some of the advantages thereof, while simultaneously overcoming some of the disadvantages normally associated therewith.

Even still another object of the present invention is to provide a portable ergonomic cushion for relieving pressure on the tail bone and support the lumbar region of the user, and is compact, portable and readily fits chairs and seats of various construction for supporting the user and relieving strain on the user. This allows greater flexibility of application of the sitting cushion of the present invention, inasmuch as the present invention can be used in conjunction with chairs and seats found everywhere, such as but not limited to a car, an aircraft or in a theater, thereby providing personalized optimum seating comfort and support. In addition, the portable ergonomic cushion of the present invention does not require the use of straps or any other similar means for the purpose of securing the cushion to a seat or chair.

Lastly, it is an object of the present invention to provide a new and improved portable ergonomic cushion for providing the combined benefits of relieving discomfort of the users tail bone while supporting the user's lumbar region and which is easily transported and used with variously shaped chairs.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
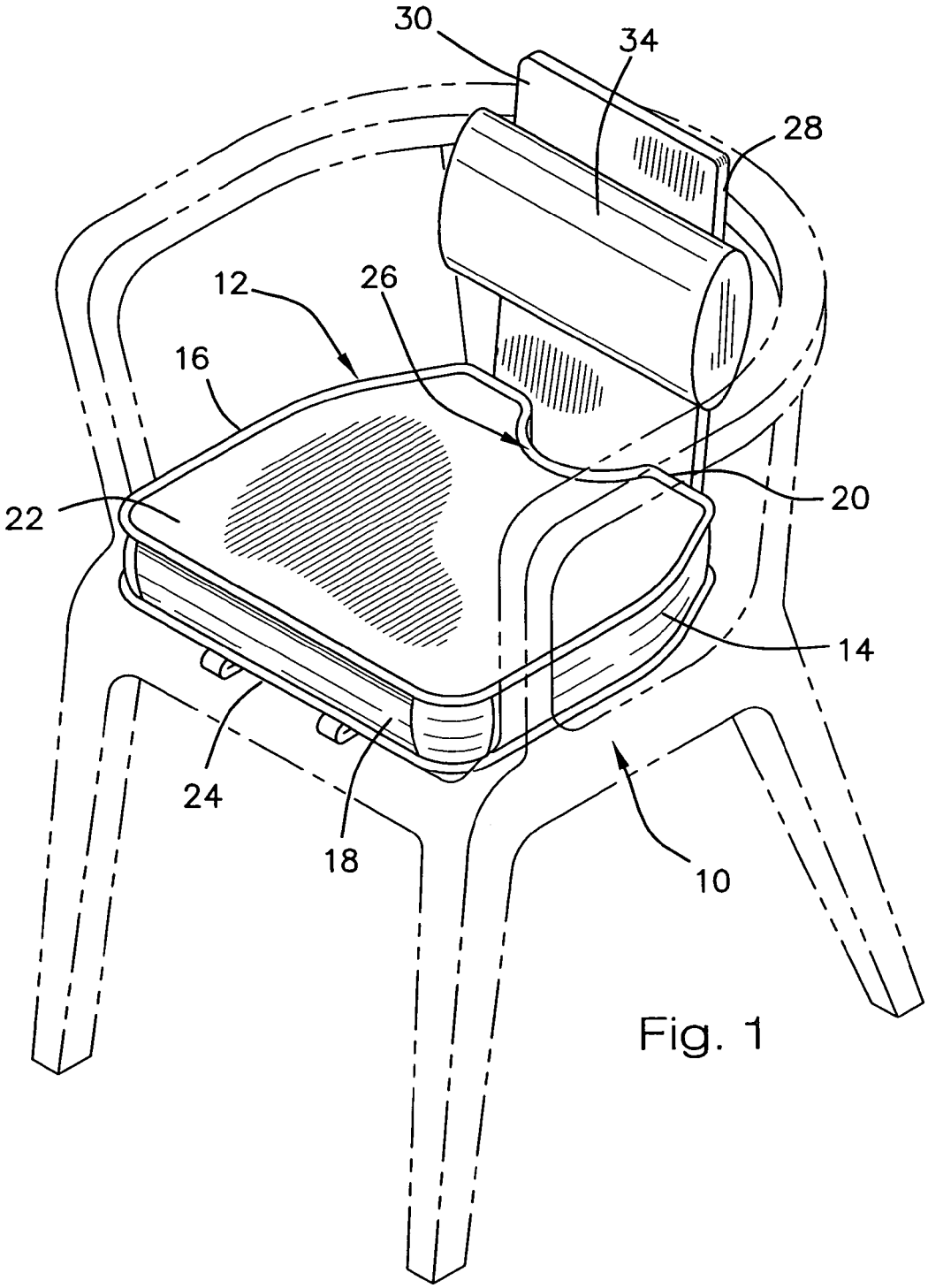
FIG. 1 is an isometric "in-use" view of the preferred embodiment of the portable ergonomic cushion constructed in accordance with the principles of the present invention.

Referring now to the drawings, and particularly to FIGS. 1–8, a preferred embodiment of the portable ergonomic cushion of the present invention is shown and generally designated by the reference numeral 10.

In FIG. 1, a new and improved portable ergonomic cushion 10 of the present invention for providing a cushion for relieving pressure on the coccyx (tail bone) and supporting the lumbar region of the user, and which is compact, portable and readily fits chairs and seats of various construction for supporting the user and relieving strain on the user is illustrated and will be described. More particularly, the portable ergonomic cushion 10 is illustrated in-use and includes a seat cushion 12 which, in the present embodiment, is generally rectangular in shape. The seat cushion 12 includes a first side 14, a second side 16, a front side 18, a back side 20, a top 22, and a bottom 24. The seat cushion 12 includes a semi-circular cutout 26 centrally located on the back side 20 thereof for relieving pressure on the user's coccyx. A back support 28 having a front surface 30 and a back surface 32 is connected to the seat cushion 12. The back support 28 is preferably at least thirty five percent (35%) narrower in width than the seat cushion 12, thus making the back support substantially narrower than the seat cushion. A lumbar support cushion 34 is removably attached to the back support 28 and is also positionable vertically therealong, thereby allowing the user to adjust the lumbar support cushion to provide maximum support and comfort. In the preferred embodiment, the length of the lumbar support cushion 34 is equal to the width of the seat cushion 12, which is measured from the first side 14 to the second side 16 across the widest span therebetween. However, it is very important to note that the lumbar support cushion 34 can be of various lengths without departing from the true scope of the invention.

Figure 2:
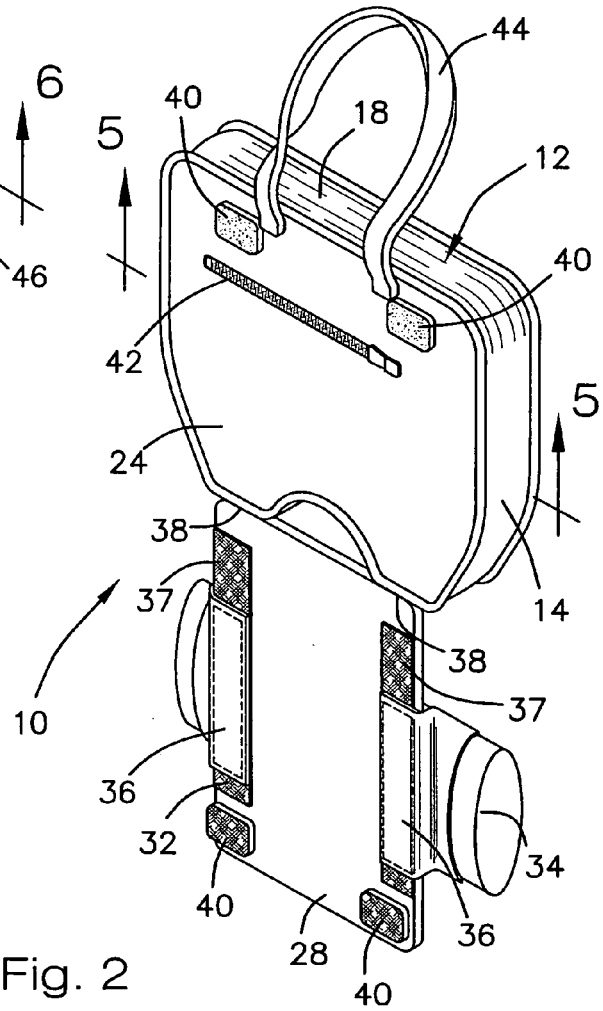
FIG. 2 is a rear isometric view of the portable ergonomic cushion of the present invention.

Moving on to FIG. 2, the portable ergonomic cushion 10 includes a back support 28 which is connected to the bottom 24 of the seat cushion 12 towards the back side 20 thereof along the bottom seam of the cushion by reinforced stitching 38. This attachment method essential provides for hinged connection between the back support 28 and the seat cushion 12. Referring back to FIG. 1, wherein the ergonomic cushion 10 is illustrated in-use, the back support 28 is sandwiched between the seat cushion 12 and the back rest of the seat which the ergonomic cushion is positioned upon, thereby supporting the back support 28 in a generally upright position without the use of strap like members attached to the back rest of the seat. One of ordinary skill in the art can appreciate the reinforced stitching 38 could be replaced by another means, which would allow the back support 28 to rotate with respect to the seat cushion 12. Such other means may include, but is not limited to cloth hinges or cloth straps.

The back support 28 and the seat cushion 12 are fitted with at least one pair of mating fasteners 40, such as a pile fastener. One matting fastener 40 is position on the rear surface 32 of the back support and the other matting fastener is position on the bottom 24 of the seat cushion 12. This allows the back support 28 to be retained in the folded position against the bottom 24 of the seat cushion 12 providing for easy transportation and storage of the portable sitting device 10. A slide fastener 42, such as a zipper, is positioned on the bottom 24 of the seat cushion 12 for allowing access to the interior of the seat cushion. Additionally, a handle 44 is attached to the bottom 24 of the seat cushion 12 towards the front side 18 thereof providing for easy carrying of the portable sitting cushion 10 when the portable ergonomic cushion is in the folded position.

A lumbar support cushion 34 is removably attached to the back support 28 and is adjustable vertically thereon to allow a user to correctly position the lumbar support cushion, thereby providing proper support and maximum comfort to the user. The lumbar cushion 34 is secured to the back surface 32 of the back support 28 by tab members 36 having pile fastener patches which mate with pile fastening strips 37 positioned along the back surface of the back support.

Figure 3:
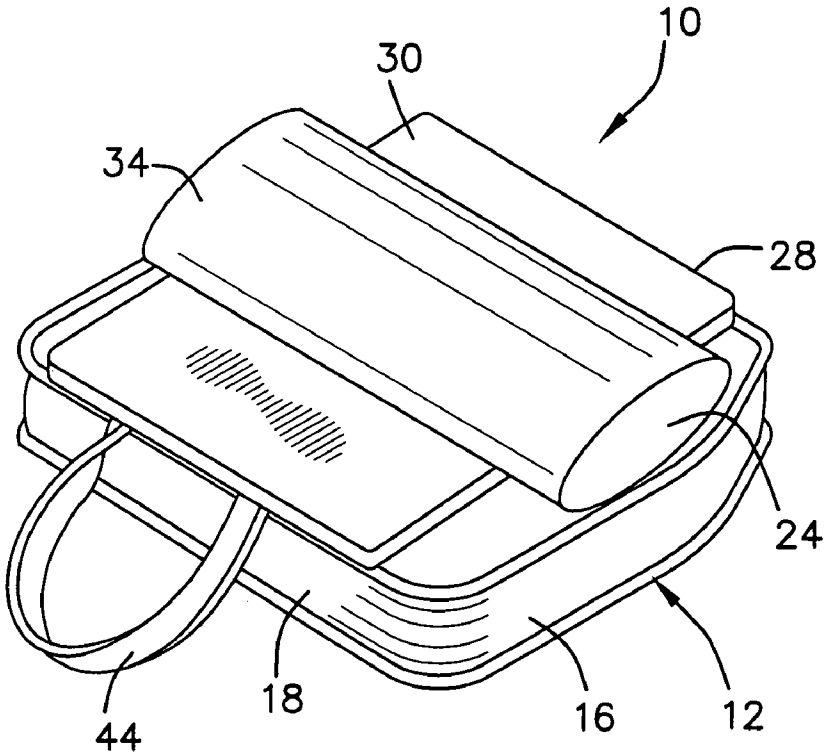
FIG. 3 is an isometric view of the portable ergonomic cushion of the present invention folded in a storage and transportation configuration.

Turning to FIG. 3, the portable ergonomic cushion 10 is illustrated in the compact folded position with the back support 28 folded against the bottom 24 of the seat cushion 12. The handle 44 is attached to and extends from the bottom 24 so that the user may easily grasp the portable ergonomic cushion 10 for transportation.

Figure 4:
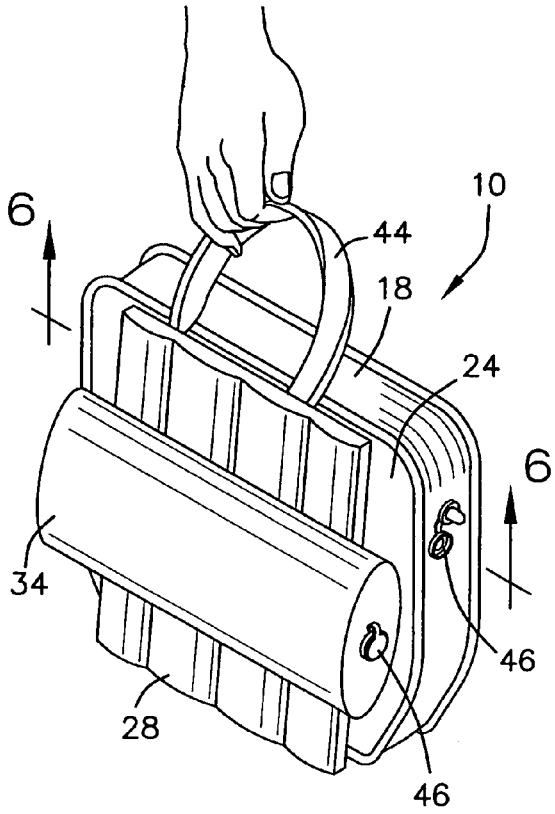
FIG. 4 is an isometric view of an alternate embodiment the portable ergonomic cushion of the present invention.

Turning to FIG. 4, the portable ergonomic cushion 10 is illustrated in an alternate embodiment wherein the seat cushion 12 and the lumbar support cushion 34 are inflatable. Inflation ports 46 are provided for inflating and deflating the lumbar support cushion 34 and the seat cushion 12 to increase or decrease the provide support to the user's preference. The back support 28 may also be fluted to increase support provided to the user.

Figure 5:
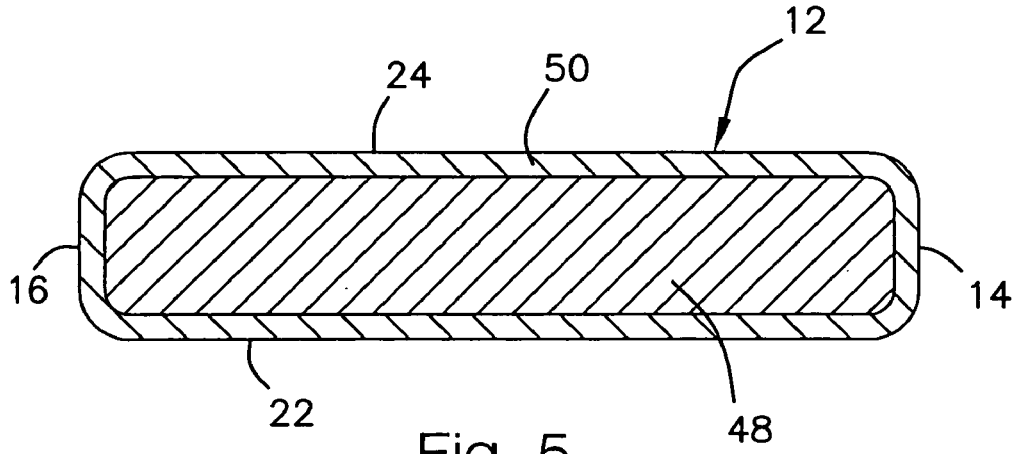
FIG. 5 is a sectional view of the portable ergonomic cushion of the present invention taken along line 5—5 in FIG. 2.

Turning to FIG. 5, a cross sectional view of the seat cushion 12 taken along line 5—5 in FIG. 2 is illustrated and will be described. More particularly, the seat cushion 12 consists of a core 48 and a covering 50 which completely encloses the core. The core 48 is manufactured from a material such as cellular foam, foam rubber, and polystyrene or a combination thereof. The covering 50 is fabricated from a material such as cloth, vinyl, velour and leather or a combination thereof.

Figure 6:
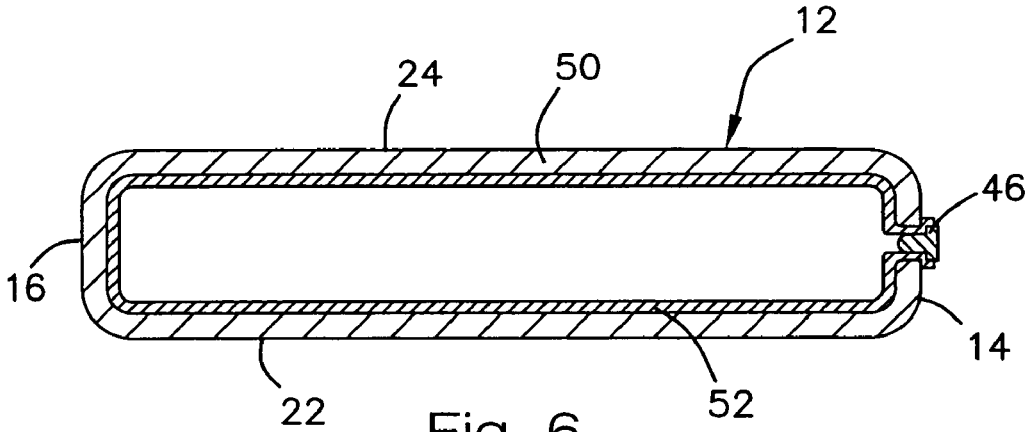
FIG. 6 is a sectional view of the portable ergonomic cushion of the present invention taken along line 6—6 in FIG. 4.

Turning to FIG. 6, a cross sectional view of the seat cushion 12 in its alternate embodiment taken along line 6—6 in FIG. 4 is illustrated and will be described. More particularly, the seat cushion 12 consists of an inflatable core 52 and a covering 50 which completely encloses the core. Inflation port 46 extends through the covering 50 and terminates at the inflatable core 52 thereby allowing the core to be inflated or deflated as so desired by the user.

Figure 7:
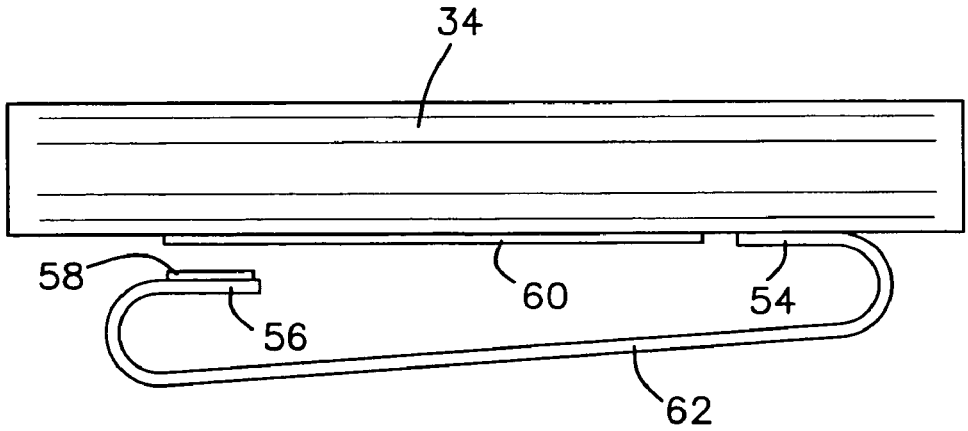
FIG. 7 is a top plan view illustrating the inflatable lumbar support cushion of the portable ergonomic cushion of the present invention.

Turning to FIG. 7, an inflateable lumbar support cushion 34 is illustrated and will be described. A strap member 62 having a first end 54 and a second end 56 is shown, wherein the first end is permanently secured to the lumbar support cushion 34 and the second end is fitted with a fastener 58, such as a pile fastener. The matting portion 60 of the fastener is provided on the lumbar support cushion 34 for adjustably securing the second end 56 of the strap member 62 to the lumbar support cushion.

Figure 8:
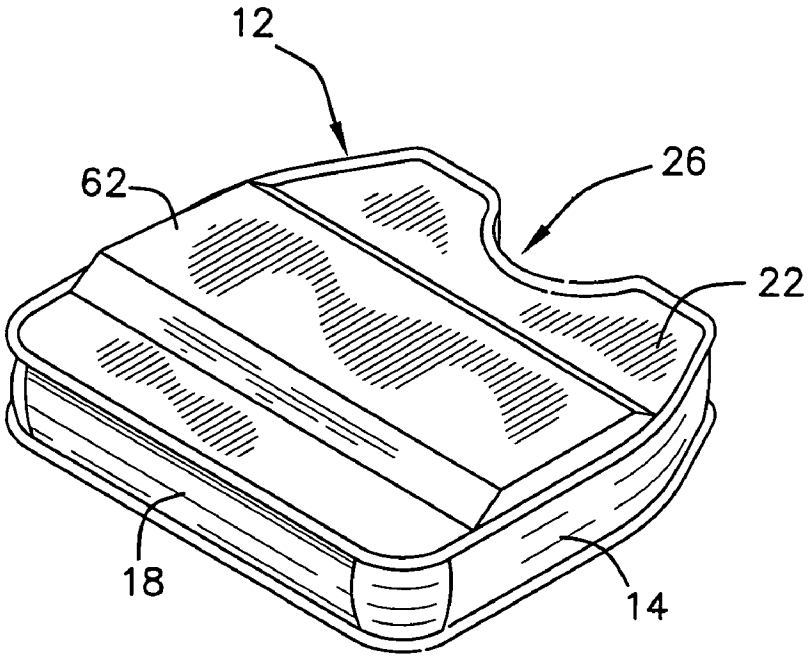
FIG. 8 is an isometric view of an alternate embodiment of the seat cushion of the portable sitting device.

Concluding with FIG. 8, an alternate embodiment of the seat cushion 12 is illustrated and will be described. More particularly, the seat cushion 12 has a raised portion 64 which extends across the top 22 of the seat cushion to properly position the user to relieve pressure on ischial tuberosities, to promote correct positioning of the sacroiliac joint, and to bring the lower back naturally against the lumbar support cushion 34.

In use, it can now be understood that, the portable ergonomic cushion 10 is positioned on a chair or seat with the top 22 of the seat cushion 12 oriented upward. The back support 28 is unfolded and positioned so as to lie against the back of the chair in which the portable ergonomic cushion 10 is positioned on. The user then sits on the portable ergonomic cushion 10 and positions his/her coccyx over the semi-circular cutout 26 so that no pressure is exerted on the coccyx. Then the user may adjust the lumbar support cushion 34 up or down along the back support 28 so that it is positioned to properly support the user's lumbar region. When the user no longer wishes to use the portable sitting cushion 10 or wishes to store or transport the portable sitting cushion the user simply folds the back support 28 back against the bottom 24 of the seat cushion 12, thereby coupling the mating fasteners 38 to secure the back support against the seat cushion 12.

While a preferred embodiment of the portable ergonomic cushion has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable ergonomic cushion comprising:

a seat cushion having a top surface, a back surface and a bottom surface, wherein said back surface defines a semi-circular cutout centrally positioned therealong;

a back support having a front surface and a back surface, said back support hingidly connected to said seat cushion, said back support is substantially narrower then said seat cushion;

a lumbar support cushion removably attached to and vertically positioned along said back support; and a pair of mating fasteners attached to said back surface of said back support and to said bottom surface of said seat cushion which are engaged to retain said back surface of said back support juxtaposed said bottom surface of said seat cushion when said back support is in a folded configuration.

2. The portable ergonomic cushion of claim 1, further comprising:

a raised portion extending along said top surface of said seat cushion for properly positioning the user to relieve pressure on ischial tuberosities, to promote correct positioning of the sacroiliac joint, and to bring the lower back naturally against the lumbar support cushion.

3. The portable ergonomic seat cushion of claim 1, further comprising:

a first fastener strip attached along said back surface of said back support;

a second fastener strip attached along said back surface of said back support; and a first tab member having an end fixedly attached to said lumbar support and a second end that is removably attachable to said first fastener strip;

a second tab member having an end fixedly attached to said lumbar support and a second end that is removably attachable to said second fastener strip; and wherein said first and second tab members are selectively positioned along said first and second fastener strips to position and retain said lumbar support on said back support.

4. The portable ergonomic seat cushion of claim 1, wherein said seat cushion comprises:

an inner inflatable core; and a removable covering completely enclosing said inner inflatable core.

5. The portable ergonomic seat cushion of claim 1, wherein:

said back support is fluted.

6. A portable ergonomic cushion comprising:

a seat cushion having a top surface, a back surface and a bottom surface, wherein said back surface defines a semi-circular cutout centrally positioned therealong; a back support having a front surface and a back surface, said back support hingidly connected to said seat cushion along the adjoining edge of said bottom surface and said back surface so that said back support is held in a generally upright position when said back support is unfolded into an in-use configuration and is placed upon a chair having a back rest, said back support is substantially narrower then said seat cushion;

a lumbar support cushion removably attached to and vertically adjustable along said back support; and a pair of mating fasteners attached to said back surface of said back support and to said bottom surface of said seat cushion which are engaged to retain said back surface of said back support juxtaposed said bottom surface of said seat cushion when said back support is in a folded configuration.

7. The portable ergonomic seat cushion of claim 6, further comprising:

a first fastener strip attached along said back surface of said back support;

a second fastener strip attached along said back surface of said back support; and a first tab member having an end fixedly attached to said lumbar support and a second end that is removably attachable to said first fastener strip;

a second tab member having an end fixedly attached to said lumbar support and a second end that is removably attachable to said second fastener strip; and wherein said first and second tab members are selectively positioned along said first and second fastener strips to position and retain said lumbar support on said back support.

8. The portable ergonomic seat cushion of claim 7, wherein said seat cushion comprises:

an inner inflatable core; and a removable covering completely enclosing said inner inflatable core.

9. The portable ergonomic seat cushion of claim 7, wherein:

said back support is fluted.

10. The portable ergonomic seat cushion of claim 9, further comprising:

a raised portion extending along said top surface of said seat cushion for properly position the user to relieve pressure on ischial tuberosities, to promote correct positioning of the sacroiliac joint, and to bring the lower back naturally against the lumbar support cushion.

* * * * *